US011873126B2

(12) United States Patent
Stevens

(10) Patent No.: US 11,873,126 B2
(45) Date of Patent: Jan. 16, 2024

(54) SEGMENTED WRAPPING FILMS AND RELATED METHODS

(71) Applicant: Inteplast Group Ltd., Livingston, NJ (US)

(72) Inventor: Scott Stevens, Edna, TX (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 17/138,142

(22) Filed: Dec. 30, 2020

(65) Prior Publication Data

US 2021/0197992 A1 Jul. 1, 2021

Related U.S. Application Data

(60) Provisional application No. 62/955,150, filed on Dec. 30, 2019.

(51) Int. Cl.
*B65B 11/02* (2006.01)

(52) U.S. Cl.
CPC ..... *B65B 11/025* (2013.01); *B65B 2210/20* (2013.01)

(58) Field of Classification Search
USPC ..... 53/556
See application file for complete search history.

(56) References Cited

U.S. PATENT DOCUMENTS 5,168,685 A * 12/1992 Suzuki ..... B65B 11/045 53/556
2014/0272306 A1* 9/2014 Helmy ..... B29C 48/917 425/72.1
2017/0313020 A1* 11/2017 Grubbs, Jr. ..... B32B 37/14
2019/0084703 A1* 3/2019 Nicholson ..... B65B 11/045

* cited by examiner

*Primary Examiner* — Chinyere J Rushing-Tucker
(74) *Attorney, Agent, or Firm* — Matthew D. Thayne; Thayne and Davis LLC

(57) ABSTRACT

Segmented wrapping materials and related methods. In some embodiments, a plurality of individual segments of a film or other wrapping material may be placed on a single roll or core and each opposing edge of each segment of such roll/core may be folded or otherwise reinforced to improve the strength of the film and thereby improve containment of a pallet or other items being wrapped with the material.

18 Claims, 2 Drawing Sheets

SEGMENTED WRAPPING FILMS AND RELATED METHODS

CROSS-REFERENCE TO RELATED APPLICATIONS

This application claims the benefit under 35 U.S.C. § 119(e) of U.S. Provisional Patent Application No. 62/955,150, which was filed Dec. 30, 2019 and titled "SEGMENTED WRAPPING FILMS AND RELATED METHODS," which is hereby incorporated herein by reference in its entirety.

SUMMARY

Embodiments of wrapping materials, such as stretch wrap films, are disclosed herein, along with implementations of related methods, such as methods for wrapping containers and/or manufacturing rolls of wrapping materials.

In preferred embodiments and implementations, films or other wrapping materials may be divided into a plurality of segments on a single roll and each opposing edge of each segment of such rolls may be folded or otherwise reinforced to improve the strength of the film and thereby improve containment of a pallet or other items being wrapped with the material.

In a more specific example of a roll of wrapping material according to some embodiments, the material may comprise a stretchable, thermoplastic wrapping material divided into a plurality of individual segments. Each of the individual segments may be positioned on a single core and/or roll. In addition, each of the plurality of individual segments preferably comprises reinforced edges along both opposing sides thereof. In some embodiments, the reinforced edges may comprise hemmed and/or folded edges. In some embodiments, the roll may be configured to maintain spacing between each adjacent segment of the plurality of segments such that the segments may be used to wrap a pallet or other item simultaneously without interference between adjacent segments during the wrapping process.

In an example of a method for wrapping a pallet or other item using a segmented film roll, the method may comprise positioning a plurality of individual film segments on a single roll. Each of the plurality of segments preferably comprises hemmed, folded, or otherwise reinforced edges such that each edge of each segment on the roll is so reinforced.

In some implementations, each of the segments may be used to wrap a pallet or other item simultaneously by extending the roll and each corresponding segment about the pallet/item together. In some implementations, the spacing between and/or position of each of the segments relative to the core of the roll may be maintained throughout the process. Alternatively, the roll or individual segments of the roll may be moved up and down vis-à-vis the core during wrapping to allow for overlapping the material of one segment with that of an adjacent segment for added wrapping strength.

In a more specific example of a method for wrapping according to some implementations, the method may comprise positioning a plurality of elongated wrapping material segments of a wrapping material formed into a roll having a hollow central axis on a single core such that each of the plurality of wrapping material segments extends along the single core with the single core extending through the hollow central axis of each of the plurality of wrapping material segments. One or more (preferably, each) of the plurality of wrapping material segments may comprise hemmed edges or other reinforced edges at both of two opposing ends of each of the plurality of wrapping material segments. A wrapping material, such as a thermoplastic stretchable packaging film, may then be wrapped from each of the plurality of wrapping material segments about a perimeter of one or more objects, such as a pallet of stacked objects.

In some implementations, the step of extending wrapping material from each of the plurality of wrapping material segments about a perimeter of an object may comprise maintaining a gap between reinforced edges of each pair of adjacent reinforced edges of the plurality of wrapping material segments. Preferably, each gap between each pair of adjacent reinforced edges comprises a distance between about 0.125 inches and about 1 inch. More preferably, each gap between each pair of adjacent reinforced edges comprises a distance between about ¼ and about ¾ of an inch.

In some implementations, the reinforced edges of each of the plurality of elongated wrapping material segments may have a length of between about 0.25 and about 1.5 inches.

In some implementations, the plurality of elongated wrapping material segments may comprise a first outer roll segment, a second outer roll segment opposite the first outer roll segment, and an inner roll segment positioned in between the first outer roll segment and the second outer roll segment.

In some implementations, the method may comprise wrapping at least a portion of the one or more objects using four layers of wrapping material, such as by overlapping two or more of the reinforced edges.

In an example of a method for wrapping a pallet of objects according to some implementations, the method may comprise wrapping a first roll segment comprising a rolled wrapping material about a full perimeter of the pallet of objects. The first roll segment may comprise a first edge and a second edge opposite the first edge, wherein both the first edge and the second edge of the first roll segment comprise reinforced edge segments comprising at least two layers of wrapping material.

The method may further comprise wrapping a second roll segment comprising a rolled wrapping material about the full perimeter of the pallet of objects. The second roll segment may comprise a first edge and a second edge opposite the first edge, wherein both the first edge and the second edge of the second roll segment comprise reinforced edge segments comprising at least two layers of wrapping material.

In some implementations, the first roll segment and the second roll segment may be wrapped about the pallet of objects from a single core extending through central axes of both the first roll segment and the second roll segment. Some implementations may comprise a third roll segment or more on the core.

In some implementations, the first roll segment and the second roll segment may be wrapped about the pallet of objects simultaneously from the single core.

In some implementations, the step of wrapping the second roll segment may comprise moving the second roll segment towards the first roll segment to form an overlapping segment in which a reinforced roll segment of the first roll segment overlaps with a reinforced roll segment of the second roll segment.

In an example of a roll of wrapping material according to some embodiments, the roll may comprise an elongated core and a plurality of roll segments, wherein each of the plurality of roll segments comprises a hollow center, wherein the elongated core extends through each of the plurality of roll segments, and wherein each of the plurality of roll segments comprises a first reinforced edge at a first end of the roll segment and a second reinforced edge at a second end of the roll segment opposite the first end.

In some embodiments, the first reinforced edge and the second reinforced edge may each comprise a hemmed edge.

In some embodiments, the first reinforced edge and the second reinforced edge may each comprise a length of between about 0.25 and about 1.5 inches.

In some embodiments, the plurality of roll segments may comprise a first outer roll segment, a second outer roll segment opposite the first outer roll segment, and an inner roll segment positioned in between the first outer roll segment and the second outer roll segment.

In some embodiments, each of the plurality of roll segments may be positioned on the elongated core with spacing between each adjacent roll segment of between about ¼ and about ¾ of an inch.

The features, structures, steps, or characteristics disclosed herein in connection with one embodiment may be combined in any suitable manner in one or more alternative embodiments.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
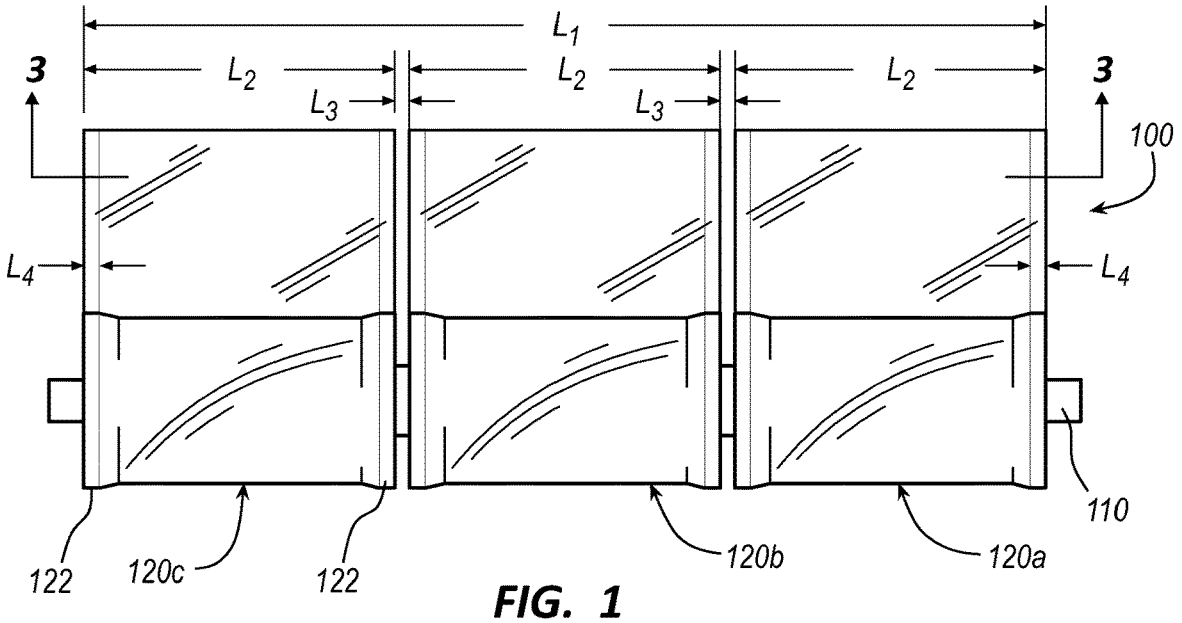
FIG. 1 is a plan view of a segmented film roll according to some embodiments.

It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure but is merely representative of possible embodiments of the disclosure. In some cases, well-known structures, materials, or operations are not shown or described in detail.

As used herein, the term "substantially" refers to the complete or nearly complete extent or degree of an action, characteristic, property, state, structure, item, or result to function as indicated. For example, an object that is "substantially" cylindrical or "substantially" perpendicular would mean that the object/feature is either cylindrical/perpendicular or nearly cylindrical/perpendicular so as to result in the same or nearly the same function. The exact allowable degree of deviation provided by this term may depend on the specific context. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

Similarly, as used herein, the term "about" is used to provide flexibility to a numerical range endpoint by providing that a given value may be "a little above" or "a little below" the endpoint while still accomplishing the function associated with the range.

The embodiments of the disclosure may be best understood by reference to the drawings, wherein like parts may be designated by like numerals. It will be readily understood that the components of the disclosed embodiments, as generally described and illustrated in the figures herein, could be arranged and designed in a wide variety of different configurations. Thus, the following detailed description of the embodiments of the apparatus and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified. Additional details regarding certain preferred embodiments and implementations will now be described in greater detail with reference to the accompanying drawings.

FIG. 1 is a plan view of a roll 100 of wrapping material or film, such as a thermoplastic stretchable packaging film or another stretch film that may be used to, for example, wrap various items, such as containers, equipment, produce, and the like, in some cases by wrapping a number of such items on a pallet. Roll 100 is placed on core 110 and is separated into a plurality of roll segments 120, namely, segment 120*a*, segment 120*b*, and segment 120*c*. Of course, as those of ordinary skill in the art will appreciate, any alternative number of segments 120 may be used on each roll/core 110 as desired.

For example, it may be desirable for some applications to simply replace a roll made up of a single segment with a roll having two adjacent segments. For still other embodiments and implementations, such as particularly large pallet stacks, more than three film segments may be provided.

In some embodiments, a gap may be provided between each adjacent segment in roll 100. For example, as shown in FIG. 1, a gap L3 may be provided between segment 120*a* and 120*b* and a similar gap L3 may be provided between segment 120*b* and 120*c*. One or more of these gaps L3 may be between about 0.125 inches and about 1 inch. More preferably, one or more of these gaps may be between about ¼ and about ¾ of an inch.

Any of various spacers available to those of ordinary skill in the art may be provided in between adjacent roll segments 120 to maintain a desired gap spacing, which may be useful to prevent adjacent segments from interfering with one another. Gap spacing may also be useful to, in some embodiments and implementations, allow individual roll segments 120 to move slightly back and forth along core 110, as described in greater detail below.

The length of the entire roll 100 L1 and/or the lengths of each individual segment L2 may also vary as desired depending upon the application and uses therefor. For example, in some embodiments, length L1 may be between about 15 inches and about 40 inches and length L2 may be between about 7.5 inches and about 15 inches.

Because the process of pre-stretching some films makes the edges prone to thinning and/or necking, each of the various segments 120 of roll 100 preferably comprises hemmed or otherwise reinforced edges 122 along both ends of each segment 120. Such reinforced edges 122 may be created by any means known or otherwise available to those of ordinary skill in the art, such as, for example, the methods disclosed in U.S. Patent Application Publication No. 2010/0015393 titled APPARATUS AND METHOD FOR FOLDING FILM EDGES, U.S. Patent Application Publication No. 2015/0321868 titled METHOD AND DEVICE FOR THE PRODUCTION OF A NUMBER OF COILED FOIL ROLLS, U.S. Pat. No. 5,565,222 titled APPARATUS FOR HEMMING EDGES OF STRETCH FILM AND FILM HAVING HEMMED EDGES, and U.S. Pat. No. 5,531,393 titled STRETCH FILM, each of which is hereby incorporated herein by reference in its entirety.

Figure 2:
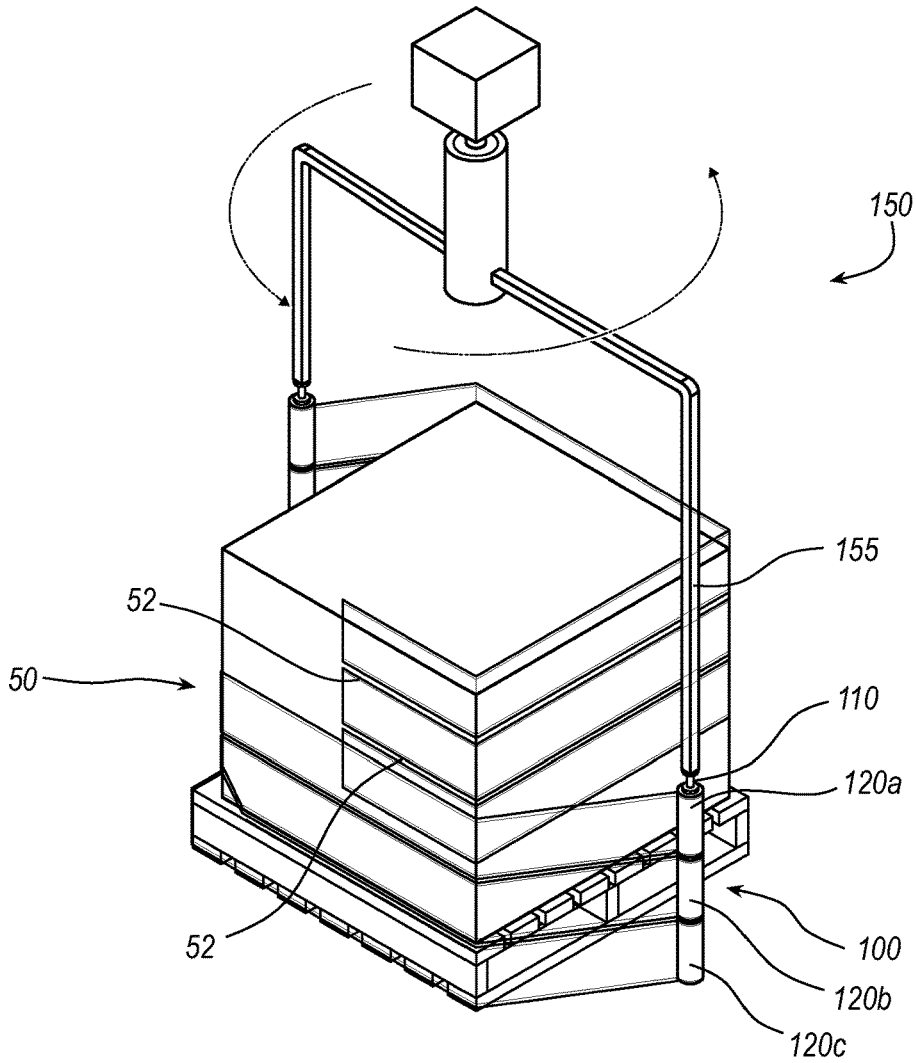
FIG. 2 is a perspective view of a machine for wrapping an item using a segmented film roll according to some embodiments.

By providing a single roll with multiple segments 120, each having reinforced edges 122, various boxes or other items 50 may be wrapped, as shown in FIG. 2, to result in stronger, more secure wrapping while using the same or a similar amount of film compared to using an unsegmented roll of film. This additional strength may be provided by simply wrapping the segmented roll 100 as is typically done with any suitable method and/or machine, which results in twice as many folded or otherwise reinforced regions 122 being used during the wrapping process per roll of film.

The length L4 of the hemmed/reinforced regions 122 may, in some preferred embodiments, be between about ¼ of an inch and about 1.5 inches.

Alternatively, a unique wrapping process may be used whereby roll 100 may be applied to item(s) 50 in an overlapping manner. For example, using a wrapping machine 150, as shown in FIG. 2, roll 100 and/or individual segments 120*a*/120*b*/120*c* may be moved up and/or down along core 110 and/or a corresponding coupling bar 155 of machine 150 or another suitable element of machine 150. In this manner, various areas of overlap 52 may be provided during the wrapping process. By providing multiple segments 120 each having opposing hemmed or otherwise reinforced edges 122, these overlapping regions 52 may, in some embodiments and implementations, comprise four layers or more of film material. Of course, in other embodiments, gaps between adjacent segments may be fixed and film may be wrapped around any various item(s) as desired without overlapping the material from adjacent segments.

Figure 3:
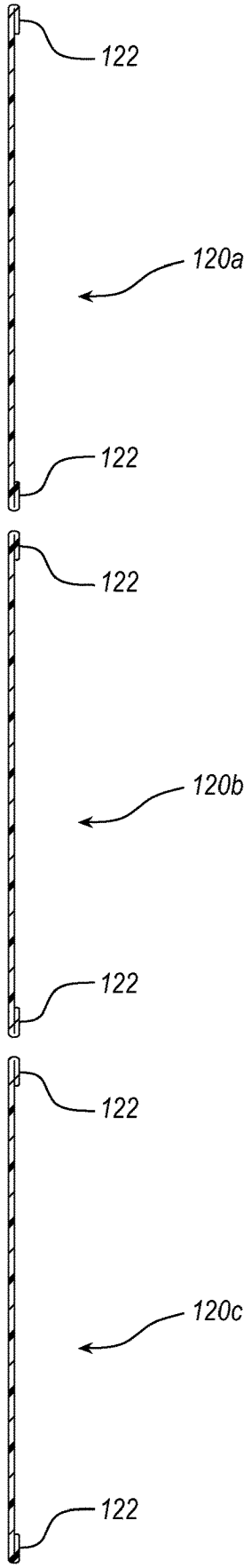
FIG. 3 is a cross-sectional view taken along line 3-3 in FIG. 1.

FIG. 3 is a cross-sectional view of roll 100, which illustrates that reinforced regions 122 of each of roll segments 120*a*, 120*b*, and 120*c* preferably comprises a folded region. Although each reinforced region 122 is shown having a single fold, such folded regions may comprise any number of folds as desired. In addition, the folds may be maintained by, for example, use of an adhesive and/or simply compressing the folded region to bond the folded material to itself. In addition, although folds may be preferred, alternative embodiments are contemplated in which reinforced regions 122 on each of the adjacent segments 120*a*/120*b*/120*c* may be formed using other techniques and may instead comprise, for example, a stamped layer of material, heat-treated edges, coatings, and the like.

It will be understood by those having skill in the art that changes may be made to the details of the above-described embodiments without departing from the underlying principles presented herein. In addition, any suitable combination of various embodiments, or the features thereof, is contemplated.

Any methods disclosed herein may comprise one or more steps or actions for performing the described method. The method steps and/or actions may be interchanged with one another. In other words, unless a specific order of steps or actions is required for proper operation of the embodiment and/or implementation, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

Those having skill in the art will therefore appreciate that many changes may be made to the details of the above-described embodiments without departing from the underlying principles of the invention. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. The scope of the present invention should, therefore, be determined only by the following claims.

The invention claimed is:

1. A roll of wrapping material, comprising:

an elongated core;

a plurality of roll segments, wherein each of the plurality of roll segments comprises a hollow center, wherein the elongated core extends through each of the plurality of roll segments, wherein each of the plurality of roll segments is separated from each adjacent roll segment of the plurality of roll segments by a fixed gap, and wherein each of the plurality of roll segments comprises a first reinforced edge at a first end of the roll segment and a second reinforced edge at a second end of the roll segment opposite the first end such that there are at least four reinforced edges positioned on the elongated core simultaneously for wrapping one or more objects simultaneously using the plurality of separated roll segments, wherein the roll is configured to maintain the fixed gap between each adjacent roll segments of the plurality of roll segments; and at least one spacer positioned between each adjacent roll segments of the plurality of roll segments, wherein the at least one spacer is configured to prevent adjacent roll segments from interfering with each other.

2. The roll of wrapping material of claim 1, wherein the first reinforced edge and the second reinforced edge each comprises a hemmed edge.

3. The roll of wrapping material of claim 1, wherein the first reinforced edge and the second reinforced edge each comprises a length of between about 0.25 and about 1.5 inches.

4. The roll of wrapping material of claim 1, wherein the plurality of roll segments comprises a first outer roll segment, a second outer roll segment opposite the first outer roll segment, and an inner roll segment positioned in between the first outer roll segment and the second outer roll segment.

5. The roll of wrapping material of claim 4, wherein each of the plurality of roll segments is positioned on the elongated core with spacing between each adjacent roll segment of between about ¼ and about ¾ of an inch.

6. The roll of wrapping material of claim 1, wherein each fixed gap comprises a distance between about 0.125 inches and about 1 inch.

7. The roll of wrapping material of claim 1, wherein the wrapping material comprises a thermoplastic stretchable packaging film.

8. The roll of wrapping material of claim 1, further comprising a wrapping machine, wherein the roll of wrapping material is coupled with the wrapping machine to allow the wrapping machine to wrap one or more objects with the wrapping material.

9. The roll of wrapping material of claim 8, wherein the one or more objects comprises a pallet having a plurality of objects stacked thereon.

10. The roll of wrapping material of claim 8, wherein the wrapping machine is configured to wrap the one or more objects by forming overlapping regions in which material from one of the plurality of roll segments at least partially overlaps material from another of the plurality of roll segments.

11. The roll of wrapping material of claim 10, wherein the wrapping machine is configured to move the roll of wrapping material up and down along a portion of the wrapping machine to form the overlapping regions.

12. The roll of wrapping material of claim 10, wherein the wrapping machine is configured to form the overlapping regions such that a reinforced edge of a first roll segment overlaps a reinforced edge of a second roll segment in an at least substantially parallel manner.

13. The roll of wrapping material of claim 10, wherein the overlapping regions comprise at least four layers of film material.

14. The roll of wrapping material of claim 1, wherein each first reinforced edge and each second reinforced edge comprises a hemmed edge.

15. The roll of wrapping material of claim 1, wherein the plurality of roll segments comprises three roll segments.

16. The roll of wrapping material of claim 15, wherein the plurality of roll segments comprises at least four roll segments.

17. The roll of wrapping material of claim 1, wherein the roll of wrapping material comprises a length of between about 15 inches and about 40 inches.

18. The roll of wrapping material of claim 1, wherein each of the plurality of roll segments comprises a length of between about 7.5 inches and about 15 inches.

* * * * *